US008657965B2

(12) United States Patent
Choi et al.

(10) Patent No.: US 8,657,965 B2
(45) **Date of Patent: *Feb. 25, 2014**

(54) CONTROLLING METHOD OF DISHWASHER

(75) Inventors: Yong Jin Choi, Seoul (KR); Joon Ho Pyo, Seoul (KR); Seong Ho Kim, Seoul (KR); Jung Youp Han, Seoul (KR); Young Hwan Park, Seoul (KR)

(73) Assignee: LG Electronics Inc., Seoul (KR)

( * ) Notice: Subject to any disclaimer, the term of this patent is extended or adjusted under 35 U.S.C. 154(b) by 1157 days.

This patent is subject to a terminal disclaimer.

(21) Appl. No.: 12/216,466

(22) Filed: Jul. 3, 2008

(65) Prior Publication Data

US 2009/0025754 A1 Jan. 29, 2009

(30) Foreign Application Priority Data

Jul. 5, 2007 (KR) ..... 10-2007-0067548

(51) Int. Cl.
*B08B 9/20* (2006.01)

(52) U.S. Cl.
USPC ..... 134/25.2; 134/18; 134/19; 134/22.1; 134/22.18

(58) Field of Classification Search
None
See application file for complete search history.

(56) References Cited

U.S. PATENT DOCUMENTS

| | | | | |
|---|---|---|---|---|
| 4,366,005 | A * | 12/1982 | Oguri et al. | 134/25.2 |
| 5,794,634 | A * | 8/1998 | Noren et al. | 134/57 D |
| 7,811,386 | B2 * | 10/2010 | Han et al. | 134/25.2 |
| 2006/0086380 | A1 * | 4/2006 | Choi et al. | 134/56 D |
| 2010/0206332 | A1 * | 8/2010 | Kim et al. | 134/18 |

FOREIGN PATENT DOCUMENTS

| | | | |
|---|---|---|---|
| DE | 2900954 | A1 | 7/1979 |
| DE | 4233936 | A1 | 4/1994 |
| KR | 10-1998-0053348 | | 2/1999 |
| KR | 10-1999-0076356 | | 10/1999 |
| KR | 10-2005-0110923 | | 11/2005 |
| KR | 10-2006-0035086 | | 4/2006 |
| KR | 10-2006-0124261 | A | 12/2006 |

* cited by examiner

*Primary Examiner* — Eric Golightly
(74) *Attorney, Agent, or Firm* — McKenna Long & Aldridge, LLP

(57) ABSTRACT

A method for controlling a dishwasher includes sequentially performing a first main washing step, a second main washing step, and a third main washing step. The first main washing step includes supplying washing water, which is heated by a sump heater, to a washing chamber. The second main washing step includes selectively performing a steam spraying action for supplying steam to the washing chamber, and performing a water supplying action for supplying washing water to the washing chamber. The third main washing step includes supplying washing water, heated by the sump heater, to the washing chamber.

9 Claims, 3 Drawing Sheets

CONTROLLING METHOD OF DISHWASHER

This application claims the benefit of Korean Patent Application No. 10-2007-0067548, filed on Jul. 5, 2007, which is hereby incorporated by reference for all purposes as if fully set forth herein.

BACKGROUND

1. Field of the Invention

The present invention relates to washing apparatuses. More specifically, the present invention relates to a method for controlling a dishwasher that enables washing of dishes in various operation modes based, for example, on the kinds of dishes being washed.

2. Discussion of the Related Art

In general, a dishwasher washes dishes automatically by removing foreign matter, such as food residue and the like, from surfaces of the dishes by spraying high pressure washing water toward the dishes in a washing chamber.

One of the most important factors of the dishwasher is its washing performance and its ability to remove substantially all of the foreign matter from the surface of the dish. Typically, washing performance is improved by increasing the spray pressure of washing water onto the dishes.

However, if the spray pressure of the washing water is excessively high, then the dishes are liable to be damaged and broken. Moreover, an increase in the spray pressure of the washing water may result in an increase in the amount of washing water, which is used for dishwashing. Furthermore, providing a high spray pressure of washing water may result in an increase in power consumption by, for example, the pump.

BRIEF SUMMARY OF THE DISCLOSED EMBODIMENTS

To solve the aforementioned problems, a method for controlling a dishwasher, which is enabled to enhance a washing performance, is provided.

In addition, a method for controlling a dishwasher, which can reduce power consumption for washing the dishes, is provided.

To achieve these features and other advantages, as embodied and broadly described herein, a method for controlling a dishwasher includes a first main washing step for supplying washing water, heated by a sump heater, to items such as dishes in a dishwasher, a second main washing step for performing a steam spraying action for supplying steam to the dishes, and a water supplying action for supplying washing water to the dishes selectively, and a third main washing step for supplying washing water, heated by the sump heater, to the dishes after the second main washing step is finished. The first main washing step, the second washing step, and the third main washing step are performed in succession.

The method may include a preliminary washing step for supplying washing water from outside of the dishwasher to the dishes for washing.

The sump heater may be turned-on when a temperature of the washing chamber in which the items to be washed or the washing water is below a preset temperature.

The sump heater may be maintained in a turned-off state during the second main washing step.

The sump heater and the steam heater for generating steam may be operated in the second main washing step, alternately.

The first main washing step may be set to a first preset time period, which may be greater than a second preset time period, which may be set for the second main washing step.

The water supplying action may include a first water supplying action for spraying water through a first spray arm, and a second water supplying action for spraying water through a second spray arm.

The first water supplying action and the second water supplying action may be performed, alternately.

The first main washing step may include a detergent supply step for supplying detergent to items, such as dishes, in the washing chamber.

The steam heater, which generates steam, may be turned-off during the first main washing step and the third main washing step.

In another aspect, a method for controlling a dishwasher includes a first main washing step for operating a sump heater for a preset time period for supplying heated washing water containing detergent to items, such as dishes, in the washing chamber, and a second main washing step for supplying washing water containing detergent and for supplying steam to the dishes, alternately.

The second main washing step may include a step for turning off the sump heater, and a step for turning on/off the steam heater periodically (or at preset times).

The second main washing step may include a steam spray step for supplying steam to the items in the washing chamber when the steam heater is in operation, and a water spray step for supplying water to items in the washing chamber when the steam heater is not in operation.

In the second main washing step, the sump heater and the steam heater may operate, alternately.

The method may further include a third main washing step for supplying washing water, heated by the sump heater, to the washing chamber after the second main washing step.

In another aspect, a method for controlling a dishwasher includes a second main washing step for supplying washing water containing detergent and steam to any item in the washing chamber, and a third main washing step for operating a sump heater when a steam heater is turned-off to supply heated washing water containing detergent for washing.

The sump heater may be turned-on only when a temperature of the washing water or a temperature inside of the washing chamber is below a preset second temperature.

The sump heater may not be turned-on during the second main washing step.

In the second main washing step, the sump heater and the steam heater may operate, alternately.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

DETAILED DESCRIPTION

Reference will now be made in detail to the specific embodiments of the present invention, examples of which are illustrated in the accompanying drawings. Wherever possible, the same reference numbers will be used throughout the drawings to refer to the same or like parts.

The dishwasher will be described with reference to FIG. 1.

Figure 1:
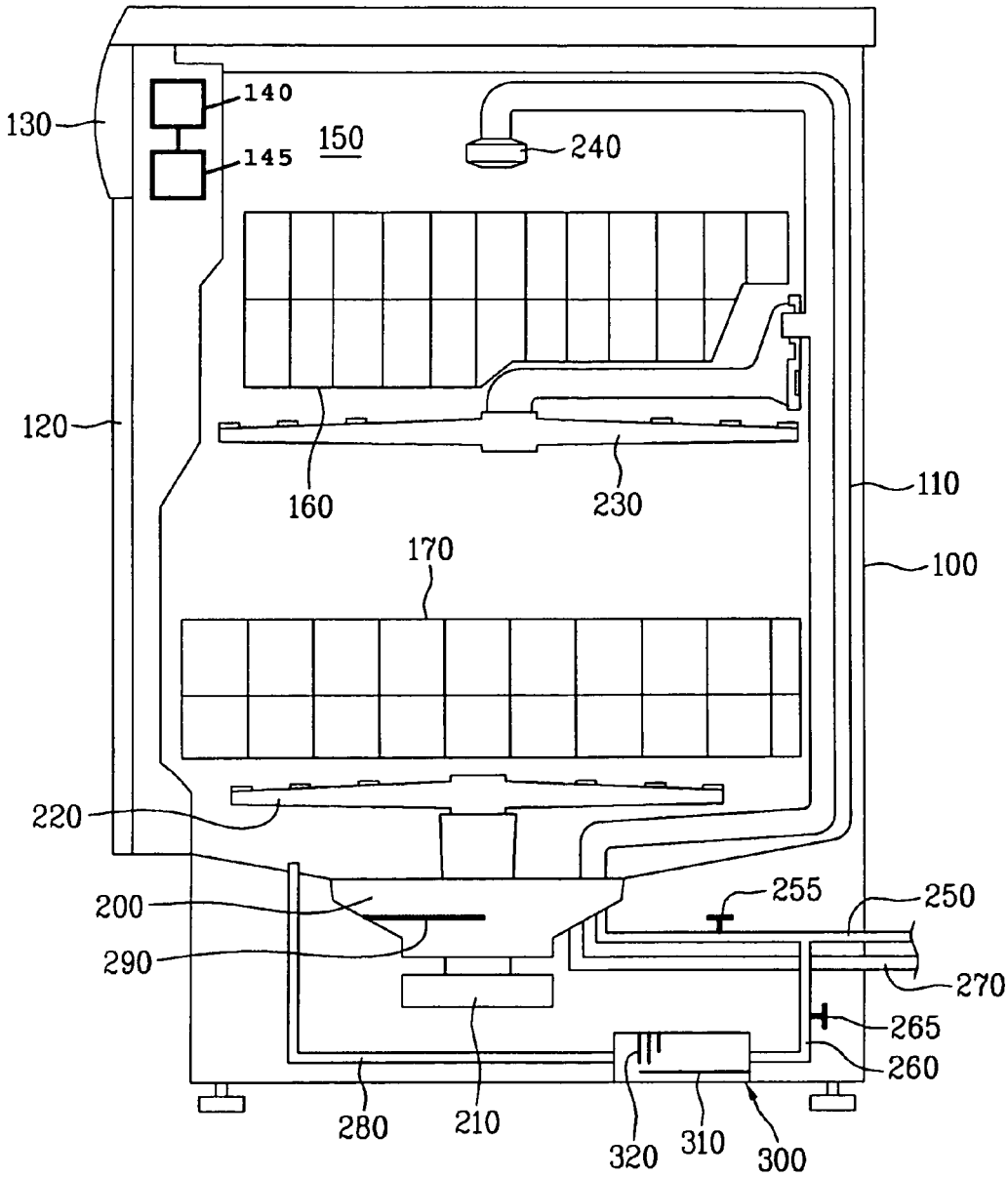
FIG. 1 illustrates of a section of a dishwasher in accordance with one embodiment.

Referring to FIG. 1, the dishwasher includes, for an example, a case 100, which forms an exterior of the dishwasher, a door 120 for opening/closing the case 100, and a control panel 130 mounted to the case 100 or the door 120 for user's operation of the dishwasher.

Within the case 100, there is a washing chamber 150 which is a space constructed of a tub 110, for placing the dishes therein and washing the dishes. Under the tub 110, there is a sump 200 for holding washing water.

Mounted to the sump 200, there is a pump 210 for pumping the washing water from the sump 200, and a filter (not shown) for filtering contaminants from the washing water. The sump 200 has a sump heater 290 provided thereto for heating the washing water in the sump 200.

The sump 200 has a first water supply pipe 250 connected thereto for having fresh water supplied thereto from an external water source, and a drain pipe 270 connected thereto for draining the washing water from the sump 200 to an outside of the dishwasher. The first water supply pipe 250 has a first water supply valve 255 mounted thereto for controlling water supply to the sump 200.

Mounted in the tub 110, i.e., in the washing chamber 150, there is at least one shelf, and at least one spray arm for spraying water pumped up by the pump 210 to the at least one shelf.

FIG. 1 illustrates an upper shelf 160 and a lower shelf 170 respectively arranged on an upper side and a lower side of the washing chamber 150, and an upper spray arm 230 and a lower spray arm 220 for spraying the water pumped by the pump 210 toward the upper shelf 160 and the lower shelf 170, respectively.

In addition, a top nozzle 240 may be arranged at a top side of the washing chamber 150 to spray the water, pumped by the pump 210, from the top side toward a lower side of the washing chamber 150.

The dishwasher not only sprays washing water by the action of pump 210 and spray arms 230, 220, but also sprays or supplies steam to the washing chamber 150. For this, the dishwasher includes a steam generator 300, which may operate independently from the sump heater 290 in the sump 210.

Referring to FIG. 1, the steam generator 300 is in communication with the first water supply pipe 250, and in communication with the washing chamber 150 through a steam supply pipe 280. Mounted to the second water supply pipe 260, there is a second water supply valve 265 for controlling water supply to the steam generator 300.

The steam generator 300 includes a steam heater 310 for heating the water supplied to the steam generator 300, and a water level sensor 320 for sensing a water level of the steam generator 300. The water level sensor 320 may sense, for example, a low water level and a high water level.

The low water level is set for protecting the steam heater 310 in the steam generator 300, and the high water level is set for preventing the water supplied to the steam generator 300 from overflowing.

A control unit 140, which controls the dishwasher, may be connected to electrically operative components, such as a control panel 130, the pump 210, and the steam generator 300, for controlling operation of the dishwasher. The control unit 140 may include a microprocessor that performs control operations. The control unit 140 may have, or be operatively coupled to a memory 145 that has, stored therein, data used by the microprocessor for control operations.

Steps for washing dishes will be described in detail with reference to at least FIGS. 1 and 2.

The steps for washing dishes with the dishwasher, as illustrated in FIG. 1, include a preliminary washing step "P," a main washing step "M," and a rinsing step "R."

The preliminary washing step P is a step for washing dishes in which washing water containing no, or substantially no, detergent may be used. The main washing step M is a step for washing the dishes in which washing water containing detergent may be used. The rinsing step R is a step for washing dishes by spraying washing water to items, such as dishes, in the washing chamber 150, that have been washed in the main washing step.

The preliminary washing step P includes supplying water to the sump 200 from a source outside of the dishwasher. The water may be supplied to the dishes at a relatively low temperature without heating. The preliminary washing step P may be performed to remove foreign matter from items, such as dishes, roughly.

During the preliminary washing step P, the water may be supplied to the upper spray arm 230 and the lower spray arm 220 and sprayed onto the dishes, alternately. That is, the water spray step in the preliminary washing step P may include an upper-side water spray step for supplying the water through the upper spray arm, and a lower-side water spray step for supplying the water through the lower spray arm. These steps may be performed repeatedly and alternately, for example, at regular intervals. For example, each of the upper-side water spray step and the lower-side water spray step may be performed for one minute.

In this example, both the steam heater 310 and the sump heater 290 are not in operation. A temperature of the washing chamber 150 into which the washing water is sprayed is substantially the same as the temperature of the water supplied to the sump from outside the dishwasher.

Of course, the present invention is not limited to the above embodiment. For example, heated washing water may be supplied in the preliminary washing step P, or the detergent may be included in the preliminary washing step P.

Upon finishing the preliminary washing step P, the main washing step M may be performed. The main washing step M includes a first main washing step M1 for spraying heated washing water to the dishes, a second main washing step M2 for spraying steam and washing water to the dishes alternately, and a third main washing step M3 for spraying heated washing water to the dishes.

In the first main washing step M1, the washing water may be heated by the sump heater 290 for a first preset time period and supplied to the dishes after the preliminary washing step P is finished. In detail, the washing water, heated by the sump heater 290, is pumped to the upper spray arm 230 and the lower spray arm 220, and sprayed toward the dishes, repeatedly and alternately.

During the first main washing step M1, the steam heater 310 may be in a turned-off state, and the first preset time period may be stored in the memory 145 of the control unit 140 prior to the first main washing step M1.

In the meantime, the sump heater 290 may heat the washing water. The heated washing water is sprayed onto items in the washing chamber 150, to elevate the atmospheric temperature of the washing chamber, i.e., the washing temperature. As shown in FIG. 2, the washing temperature of the washing chamber may be represented by a linear graph in the first main washing step.

The second main washing step M2 includes supplying steam and washing water, alternately, for a second preset time period upon completion of the first main washing step M1. In other words, in the second main washing step M2, the steam spray step for supplying steam to the dishes and the water spray step for supplying washing water to the dishes may be performed for a preset number of times, repeatedly and alternately.

The water spray step serves to remove foreign matter from items in the washing chamber 150, and the steam spray step serves to soak the foreign matter such that foreign matter may be removed from the items with relative ease.

In the steam spray step, the steam heater 310 is in a turned-on state to generate steam. In the water spray step, the steam heater 310 is in a turned-off state. That is, in the second main washing step M2, the sump heater 290 may be in a turned-off state, and the steam heater 310 is turned-on/off periodically to supply washing water and steam to the dishes, alternately. The second preset time period may be set shorter than the first preset time period.

Since the sump heater 290 is maintained in a turned-off state during the second main washing step M2, the water spray step may include supplying unheated washing water to the dishes through the upper spray arm 230 and the lower spray arm 220. In this example, because water is alternately supplied in the second main washing step M2 without being heated, power consumption can be reduced by, for example, having the sump heater 290 in a turned-off state.

In the meantime, an atmospheric temperature of the washing chamber 150 rises gradually as a result of the steam supply. For example, in the steam supply step, the washing temperature of the washing chamber 150 may be represented by a stepped form, as illustrated in FIG. 2, in which the washing temperature rises momentarily in comparison to the washing temperature in the water supply step.

Figure 2:
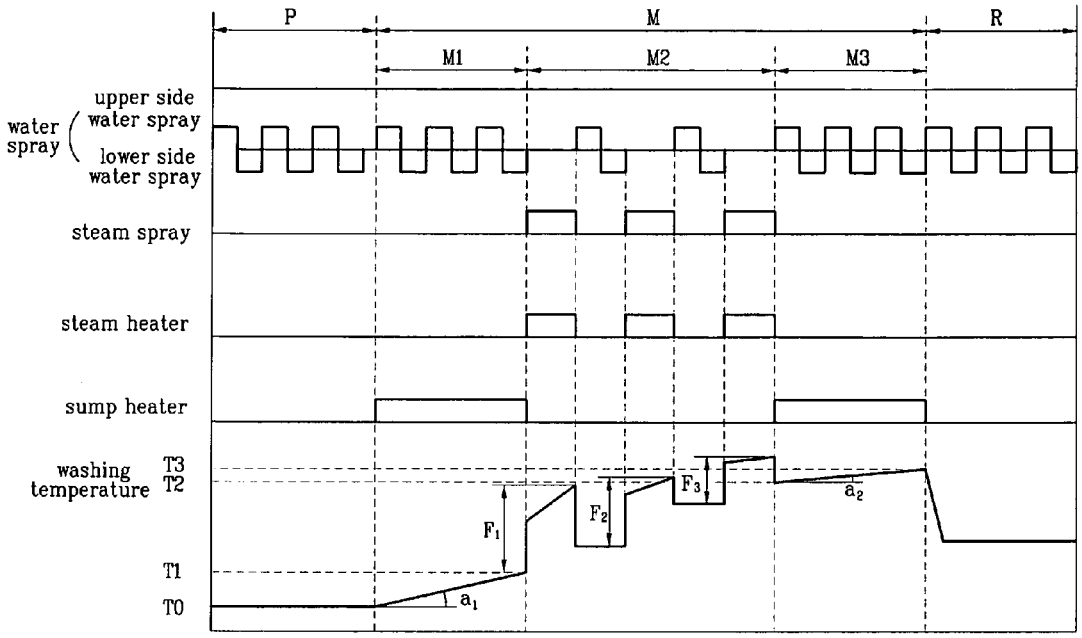
FIG. 2 illustrates a timing chart of an operation of the dishwasher in FIG. 1.

FIG. 2 further illustrates that the amount of temperature rise of F1, F2, and F3 in the steam supply steps become smaller, gradually. For example, the amount of temperature rise associated with F1 may be greater than the amount of temperature rise associated with F2. The amount of temperature rise associated with F2 may be greater than the amount of temperature rise associated with F3. Since the washing temperature of the washing chamber 150 has risen to a certain temperature as the steam spray is progressed, the influence of the temperature of the steam spray made thereafter becomes weaker with respect to the washing temperature of the washing chamber 150. That is, because a temperature difference between the steam and the washing chamber 150 may be reduced gradually if the steam spray is performed repeatedly, an amount of heat transfer from the steam to the washing chamber 150 may be reduced, gradually.

The third main washing step M3 includes supplying washing water to the items, such as dishes, in the washing chamber 150. The washing water may be heated by the sump heater 290 for a third set time period upon completion of the second main washing step M2.

In detail, the washing water, heated by sump heater 290, is pumped to the upper spray arm 230 and the lower spray arm 220, and sprayed to the dishes, alternately. In this example, the steam heater 310 may be in a turned-off state.

In the meantime, the washing water, heated by sump heater 290, is supplied to the washing chamber 150, to elevate the washing temperature of the washing chamber 150. In the example illustrated in FIG. 2, the third main washing step M3 includes a characteristic of supplying water, which has been heated by sump heater 290. This is similar to a characteristic of the first main washing step M1. However, the washing temperature of the washing chamber 150 in the third main washing step M3 is higher than the washing temperature of the washing chamber in the first main washing step M1. This is because the temperatures of the dishes and the washing chamber have already been elevated to a certain temperature via the second main washing step M2.

Moreover, a second slope a2, indicating an amount of change of the washing chamber temperature in the third main washing step M3, has a value smaller than a first slope a1, indicating an amount of change of the washing chamber temperature in the first main washing step M1.

That is, under the assumption that operation time periods of the first main washing step M1 and the third main washing step M3 are the same, the amount of temperature change T1-T0 in the first main washing step M1 is greater than the amount of temperature change T3-T2 in the third main washing step M3.

Most likely, because the washing chamber temperature in the third washing step M3 has already been elevated to a certain temperature in the third washing step M3, the influence of the temperature of the washing water, heated by sump heater 290, with respect to the washing chamber 150 is relatively smaller than the influence of the temperature of the washing water with respect to the washing chamber 150 in the first main washing step M1.

If the main washing step M is finished, then the circulated washing water may be drained out of the dishwasher through the drainpipe 270, and fresh water may be supplied to the items, such as dishes, in the washing chamber 150, to start the rinsing step R. The rinsing step R may include supplying unheated washing water to items, such as dishes, in the washing chamber 150. Even though washing water, which is not heated, is supplied, for example, to dishes, the washing temperature of the washing chamber 150 associated with the rinsing step R is higher than the washing temperature of the washing chamber 150 associated with the preliminary washing step P. This is because temperatures of the items, such as dishes, and the washing chamber 150 have already risen to certain temperatures as a result of the main washing step M.

Of course, in the rinsing step R, heated water may be supplied, or water and steam may be sprayed at the same time or alternately. Moreover, a drying step "D" may be performed once the rinsing step R is finished. The drying step D may include drying the dishes by supplying cold air, and/or hot air to the items, such as dishes, in the washing chamber 150.

A main washing step M in accordance with another embodiment will be described with reference to FIGS. 1 and 3.

Similar to the foregoing embodiment illustrated in FIG. 2, a method for controlling a dishwasher in accordance with another embodiment may include a preliminary washing step P, a main washing step M, and a rinsing step R.

The main washing step M may include a first main washing step M1 for supplying heated washing water to the dishes, a second main washing step M2 for supplying steam and washing water to the dishes repeatedly and alternately, and a third main washing step M3 for supplying heated washing water to items, such as dishes, within the washing chamber 150.

Figure 3:
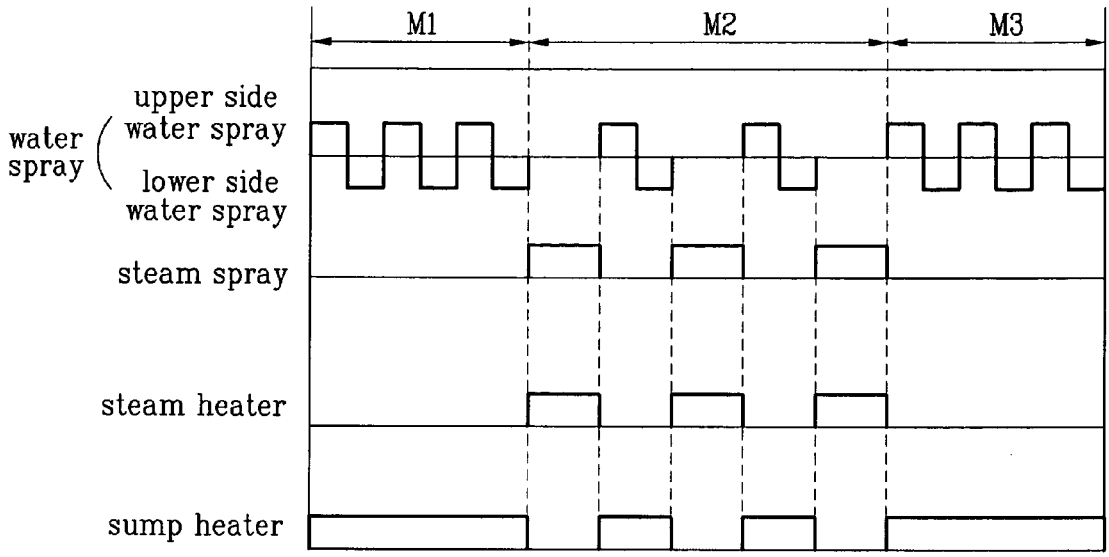
FIG. 3 illustrates a timing chart of an operation of the main washing step in FIG. 2 in accordance with another embodiment.

However, the second main washing step M2 of the method for controlling a dishwasher in accordance with the embodiment of FIG. 3 may include supplying heated washing water instead of unheated washing water, as discussed in FIG. 2.

Referring to FIG. 3, in the steam spray step of the second main washing step M2, the steam heater 310 is turned-on and the sump heater 290 is turned-off. In the water spray step of the second main washing step M2, the sump heater 290 is turned-on and the steam heater 310 is turned-off.

As a result, in the second main washing step M2, the sump heater 290 and the steam heater 310 are turned-on/off alternately and repeatedly. Moreover, in the water spray step, an upper-side water spray step for supplying water through the upper spray arm 230, and a lower-side water spray step for supplying water through the lower spray arm 220 may be performed, alternately.

It will be apparent to those skilled in the art that various modifications and variations can be made without departing from the spirit or scope of the invention. Thus, it is intended that the present invention cover the modifications and variations provided that they come within the scope of the appended claims and their equivalents.

The method for controlling a dishwasher of the present invention has the following industrial applicability.

First, the application of the second main washing step, which includes spraying steam and washing water alternately, after application the first main washing step, which includes supplying heated washing water after a pre-washing step, permits effective washing of the dishes with a relatively small amount of steam.

Second, the application of steps in which heated water is supplied before and after the second main washing step enhances washing performance, and reduces the amount of power consumed and required for the generation of steam.

What is claimed is:

1. A method for controlling a dishwasher comprising:

a first main washing step including heating washing water by a sump heater and supplying the heated washing water to dishes of a washing chamber;

a second main washing step including performing a steam supplying action to supply steam heated by a steam heater to the dishes of the washing chamber, and a water supplying action to supply washing water to the dishes of the washing chamber, selectively; and a third main washing step including heating washing water by a sump heater and supplying the washing water heated to the dishes of the washing chamber, wherein the first main washing step, the second washing step, and the third main washing step are performed in succession, wherein the second main washing step includes performing the steam supplying action and water supplying action repeatedly and alternately, and wherein the sump heater is turned off during the second main washing step.

2. The method according to claim 1, further comprising a preliminary washing step including supplying washing water to the washing chamber.

3. The method according to claim 2, wherein the sump heater is turned off during the preliminary washing step.

4. The method according to claim 1, wherein the sump heater is turned on when a temperature of the washing water or a temperature of a washing chamber is less than a first predetermined temperature.

5. The method according to claim 1, wherein the first main washing step is set to a first predetermined time period and the second main washing step is set to a second predetermined time period, wherein the first predetermined time period is greater than the second predetermined time period.

6. The method according to claim 1, wherein the water supplying action includes:

a first water supplying action to supply water via a first spray arm; and a second water supplying action to supply the water via a second spray arm.

7. The method according to claim 6, wherein the first water supplying action and the second water supplying action are performed alternately.

8. The method according to claim 1, wherein the first main washing step includes a detergent supply step that includes supplying detergent to the washing chamber.

9. The method according to claim 1, wherein the steam heater is turned off during the first main washing step and the third main washing step.

* * * * *